US009966666B2

(12) United States Patent
Kim et al.

(10) Patent No.: US 9,966,666 B2
(45) Date of Patent: May 8, 2018

(54) ANTENNA DEVICE AND ELECTRONIC APPARATUS HAVING THE SAME

(71) Applicant: Samsung Electronics Co., Ltd., Suwon-si, Gyeonggi-do (KR)

(72) Inventors: Hyun-Jin Kim, Seoul (KR); Goudelev Alexander, Suwon-si (KR); Anton S. Lukyanov, Suwon-si (KR); Won-Bin Hong, Seoul (KR); Byung-Chul Kim, Hwaseong-si (KR); Young-Ju Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 166 days.

(21) Appl. No.: 14/341,194

(22) Filed: Jul. 25, 2014

(65) Prior Publication Data

US 2015/0035715 A1 Feb. 5, 2015

(30) Foreign Application Priority Data

Aug. 1, 2013 (KR) ..... 10-2013-0091551

(51) Int. Cl.
*H01Q 9/04* (2006.01)

(52) U.S. Cl.
CPC ..... *H01Q 9/0421* (2013.01)

(58) Field of Classification Search
CPC ..... H01Q 9/0421
USPC ..... 343/787
See application file for complete search history.

(56) References Cited

U.S. PATENT DOCUMENTS 6,476,771 B1 * 11/2002 McKinzie, III ..... H01Q 1/425 333/134
7,190,315 B2 * 3/2007 Waltho ..... H01Q 1/28 343/705
7,215,007 B2 * 5/2007 McKinzie, III ..... H01P 1/16 257/664
7,911,386 B1 3/2011 Itoh et al.
2003/0137457 A1 * 7/2003 McKinzie, III .... H01Q 15/0013 343/700 MS
2004/0119658 A1 6/2004 Waltho
(Continued)

FOREIGN PATENT DOCUMENTS

CN 1367946 A 9/2002
CN 102893455 A 1/2013

OTHER PUBLICATIONS

Al-Nuaimi et al.; Ultra Thin Dipole Antenna Backed by New Planar Artificial Magnetic Conductor; Loughborough Antennas and Propagation Conference; LAPC 2009; pp. 97-100; 2009; Loughborough, UK—Conference Proceedings.
(Continued)

*Primary Examiner* — Dieu H Duong
*Assistant Examiner* — Bamidele A Jegede
(74) *Attorney, Agent, or Firm* — Jefferson IP Law, LLP

(57) ABSTRACT

An antenna device is provided. The antenna device may include a conductive radiator pattern formed on one surface of a dielectric substrate, an artificial magnetic conductor layer including at least one unit cell formed on the other surface of the dielectric substrate, and a shorting pin connected to the unit cell. The artificial magnetic conductor layer may be configured to form an induction current of the same phase with regard to a signal current flowing through the conductive radiator pattern.

17 Claims, 6 Drawing Sheets

(56) References Cited

U.S. PATENT DOCUMENTS

| | | | | |
|---|---|---|---|---|
| 2004/0263420 | A1 | 12/2004 | Werner et al. | |
| 2010/0007569 | A1* | 1/2010 | Sim | H01Q 1/2225 343/795 |
| 2010/0039193 | A1* | 2/2010 | Ryou | H01P 5/08 333/219 |
| 2010/0171563 | A1* | 7/2010 | Dupuy | H01P 1/15 333/103 |
| 2010/0263199 | A1* | 10/2010 | Morton | H01P 1/2005 29/600 |
| 2011/0181490 | A1 | 7/2011 | Jung et al. | |
| 2013/0057443 | A1 | 3/2013 | Asanuma et al. | |
| 2013/0162491 | A1 | 6/2013 | Yu | |

OTHER PUBLICATIONS

Lau et al.; A Wideband High Gain Dipole EBG Reflector Antenna; ICICS 2011; IEEE; 2011; China.

* cited by examiner

ANTENNA DEVICE AND ELECTRONIC APPARATUS HAVING THE SAME

CROSS-REFERENCE TO RELATED APPLICATION(S)

This application claims the benefit under 35 U.S.C. § 119(a) of a Korean patent application filed on Aug. 1, 2013 in the Korean Intellectual Property Office and assigned Serial number 10-2013-0091551, the entire disclosure of which is hereby incorporated by reference.

TECHNICAL FIELD

The present disclosure relates to an antenna device. More particularly, the present disclosure relates to an antenna device including an artificial magnetic conductor layer and an electronic apparatus having the same.

BACKGROUND

Development of wireless communication technology has enabled transmission/reception and sharing of data between different electronic apparatuses. For example, it is possible to directly transmit multimedia files, including image files, stored in a digital camera or a multimedia playback device, to a smartphone or a laptop computer. Technology for transmitting data between electronic apparatuses is also useful in medical fields. For example, information regarding patients obtained from a medical electronic apparatus, such as an electrocardiography (ECG) sensor, which is attached to a human body, can be transmitted to a personal computer, a mobile communication terminal, etc. Such wireless transmission/reception is largely based on Wi-Fi technology, with which a limited number of electronic apparatuses (e.g. laptops, smartphones, etc.) have been equipped. Recently, more diversified apparatuses (e.g. game consoles, printers, TVs, etc.) have also been equipped with Wi-Fi technology.

An electronic apparatus that is designed to be portable or an apparatus that is designed to be attached to a human body needs an antenna device that can exhibit stable performance with a compact size, in order to reduce discomfort experienced by the user or patient. An electronic apparatus using a metallic case, such as a small digital camera, has a pleasing aesthetic appearance, but the material of the case makes it difficult to secure stable antenna performance. Therefore, part of the metallic case may be removed to secure stability of wireless transmission/reception. However, removal of a part of the case compromises the aesthetic appearance provided by the metallic case. A medical electronic apparatus to be attached to a human body preferably gives the patient, to whom it is attached, no discomfort, while the antenna device exhibits stable operating characteristics. A bowtie dipole antenna having a size of 40 mm×25 mm, which has been commercialized as an ECG sensor antenna, exhibits a radiation efficiency of 95% before being attached to a human body, but the radiation efficiency drops to 5% in an actual environment of use, e.g. when attached to a human body.

The above-mentioned antenna devices are capable of wireless transmission/reception in poor operating environments, e.g. when installed inside a metallic case or when attached to a human body, as long as they are manufactured with a sufficient size. However, as described above, a compact electronic apparatus or an apparatus that is supposed to be attached to a human body needs to be compact and light, while securing stable operating characteristics of the antenna device, in order to make the user less uncomfortable.

Further to the above considerations, the radiator of an antenna device requires a distance of at least ¼ of the signal wavelength from the ground surface of an electric conductor. If the distance between the radiator and the ground surface of the electric conductor is less than ¼ of the signal wavelength, a surface current is induced on the ground surface in the opposite direction of the current flowing through the radiator. In that case, the signal current of the radiator is offset by the current on the ground surface, thus preventing the antenna device from functioning. The magnetic conductor operates as a component having the function of an open circuit with a considerably high resistance at a specific frequency. This can be realized by periodically arranging a cell pattern of an intended specific unit on the electric conductor, and a magnetic conductor made in this manner is referred to as an artificial magnetic conductor (AMC). A radiator arranged on the AMC may be arranged closer to the ground surface than the radiator of a conventional antenna device. However, there is a limit to making an AMC, which requires periodic arrangement of a cell pattern of a specific unit, small enough to be applied to a compact electronic apparatus and an apparatus to be attached to human bodies.

Antenna devices using AMCs are disclosed in a paper published by IEEE ICICS in 2011, entitled "A Wideband High Gain Dipole EBG Reflector Antenna (P. Lau, etc.)", in a paper published at the Antenna and Propagation Conference in 2009, entitled "Ultra Thin Dipole Antenna backed by new planar artificial magnetic conductor (M. Al-Nuaimi etc.)", etc.

Antenna devices disclosed in the above-referenced papers utilize AMCs composed of a unit cell combination with a 7×7 arrangement or a unit cell combination with a 9×5 arrangement, and their horizontal×vertical size exceeds 50 mm×50 mm, placing a limit on mounting them on compact electronic apparatuses or medical electronic apparatuses which are attached to human bodies.

Accordingly, there is a need for an improved antenna device that is compact and light, and an electronic apparatus having the same.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an antenna device that is compact and light, and an electronic apparatus having the same.

Another aspect of the present disclosure is to provide an antenna device exhibiting stable performance even in poor operating environments, e.g. when arranged adjacent to metal or human bodies, and an electronic apparatus having the same.

In accordance with an aspect of the present disclosure, an antenna device is provided. The antenna device includes a conductive radiator pattern formed on one surface of a dielectric substrate, an artificial magnetic conductor layer including at least one unit cell formed on the other surface of the dielectric substrate, and a shorting pin connected to the unit cell. The artificial magnetic conductor layer may be configured to form an induction current of the same phase with regard to a signal current flowing through the conductive radiator pattern.

In the above-described antenna device, the unit cell may be composed of a metal pattern forming a resonance circuit composed of a parallel inductance and a series capacitance.

In accordance with an aspect of the present disclosure, the unit cell is provided. The unit cell includes a first conductor unit pattern, second conductor unit patterns formed adjacent to both ends of the first conductor unit pattern, respectively, and gaps formed between the first conductor unit pattern and respective second conductor unit patterns. The antenna device may form capacitive coupling between the first and second conductor unit patterns through the gaps.

In the above-described antenna device, a plurality of the first and second conductor unit patterns may be arranged alternately to form capacitive coupling.

The shorting pin may be connected to one of the first and second conductor unit patterns at one end of arrangement of the unit cells.

In addition, the first or second conductor unit patterns may provide a grounding unit and inductive coupling between the gap and an adjacent different gap.

An electronic apparatus having an antenna device according to various embodiments of the present disclosure may include a main circuit substrate, and an antenna device arranged on the main circuit substrate, and the antenna device may include a dielectric substrate arranged to face the main circuit substrate, a conductive radiator pattern formed on one surface of the dielectric substrate, an artificial magnetic conductor layer composed of a metal pattern formed on the other surface of the dielectric substrate, and a shorting pin connected to the artificial magnetic conductor layer. The shorting pin may be configured to short the artificial magnetic conductor layer to the main circuit substrate.

The artificial magnetic conductor layer may be formed on a surface of the dielectric substrate facing the main circuit substrate.

In an embodiment, the artificial magnetic conductor layer may include at least one unit cell composed of a first conductor unit pattern and a pair of second conductor unit patterns, and the first and second conductor unit patterns may form capacitive coupling.

The shorting pin may be configured to short one of the first and second conductor unit patterns to ground of the main circuit substrate.

In the above-described antenna device, a plurality of first conductor unit patterns and a plurality of second conductor unit patterns may be alternately arranged in series.

The shorting pin may be configured to short one of the first and second conductor unit patterns to the ground at one end of the arrangement of the first and second conductor unit patterns.

The antenna device according to various embodiments of the present disclosure forms an artificial magnetic conductor layer on one surface of a dielectric substrate using a metal pattern only, and connects a shorting pin to compensate for the inductance component, making it possible to configure an artificial magnetic conductor using only a small number of unit cells. Therefore, stable operating characteristics can be secured while reducing the size of the artificial magnetic conductor, and thus that of the antenna device. Furthermore, arrangement of a radiator on the artificial magnetic conductor makes it possible to secure stable radiation performance of the antenna device even when arranged inside an electronic apparatus made of a metallic case or when operating adjacent to a human body.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
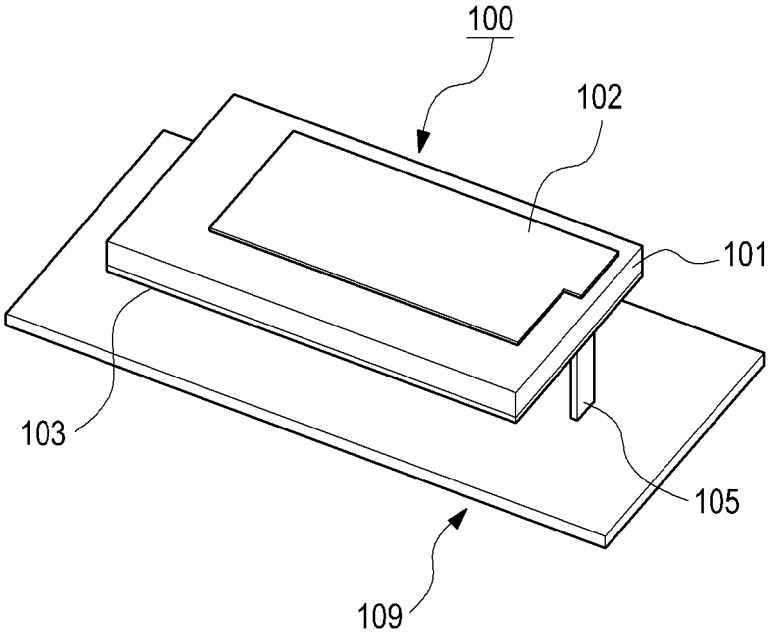
FIG. 1 is a perspective view schematically illustrating an antenna device according to an embodiment of the present disclosure.
Figure 2:
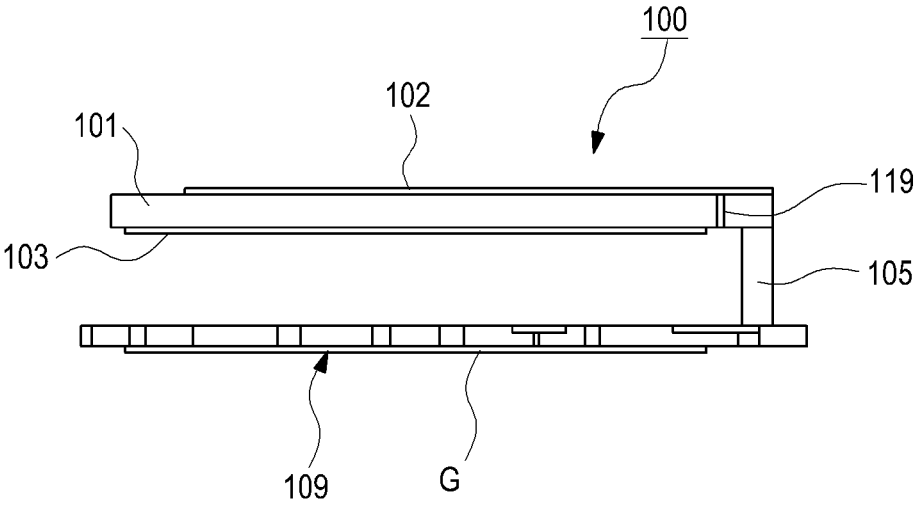
FIG. 2 is a side view illustrating an antenna device according to an embodiment of the present disclosure.

FIG. 1 is a perspective view schematically illustrating an antenna device according to an embodiment of the present disclosure. FIG. 2 is a side view illustrating an antenna device according to an embodiment of the present disclosure.

Referring to FIG. 1 and FIG. 2, an antenna device 100 according to various embodiments of the present disclosure may have a conductive radiator pattern 102 formed on one surface of a dielectric substrate 101 and an artificial magnetic conductor (AMC) layer 103 formed on the other surface of the dielectric substrate 101. For example, the conductive radiator pattern 102 and the AMC layer 103 may be formed on opposite surfaces of the dielectric substrate 101, respectively. In general, an AMC is structured in such a manner that a ground layer is formed on one surface of a dielectric substrate, cells of a specific pattern are periodically arranged on the other surface, and each cell is connected to the ground through a via hole, for example. In contrast, in the case of a configuration of the antenna device 100 according to various embodiments of the present disclosure, the AMC layer 103 may be solely composed of a unit cell having a metal pattern, e.g. a predetermined pattern. When a signal current is applied to the conductive radiator pattern 102, the AMC layer 103 forms an induction current of the same phase with regard to the signal current flowing through the conductive radiator pattern 102, thereby the improving radiation performance of the antenna device 100.

The antenna device 100 may have a shorting pin 105 connected to the dielectric substrate 101, e.g. connected to one of the metal patterns constituting the AMC layer 103. Since the AMC layer 103 is solely composed of metal patterns, unlike AMCs of the related art, it may have an inductance component smaller than that formed by the ground, via holes, etc., of the AMC structure of the related art. The shorting pin 105 compensates for the inductance component of the AMC layer 103, so that the antenna device 100 can be compact while including an AMC structure.

According to an embodiment, the shorting pin 105 may be shorted to a different circuit substrate, e.g. to a main circuit substrate 109 of an electronic apparatus. The antenna device 100, e.g. the AMC layer 103 may be provided with feeding or grounding through the shorting pin 105. The shorting pin 105 may include a connection member, such as a flexible printed circuit board, a metal conductor, or a C-clip. In other words, the shorting pin 105 may be composed of anything capable of delivering electric signals. The conductive radiator pattern 102 may be connected to a feeding circuit or a grounding unit G, which is provided on the main circuit substrate 109, through via holes 119 extending through the dielectric substrate 101, another shorting pin, etc.

Figure 3:
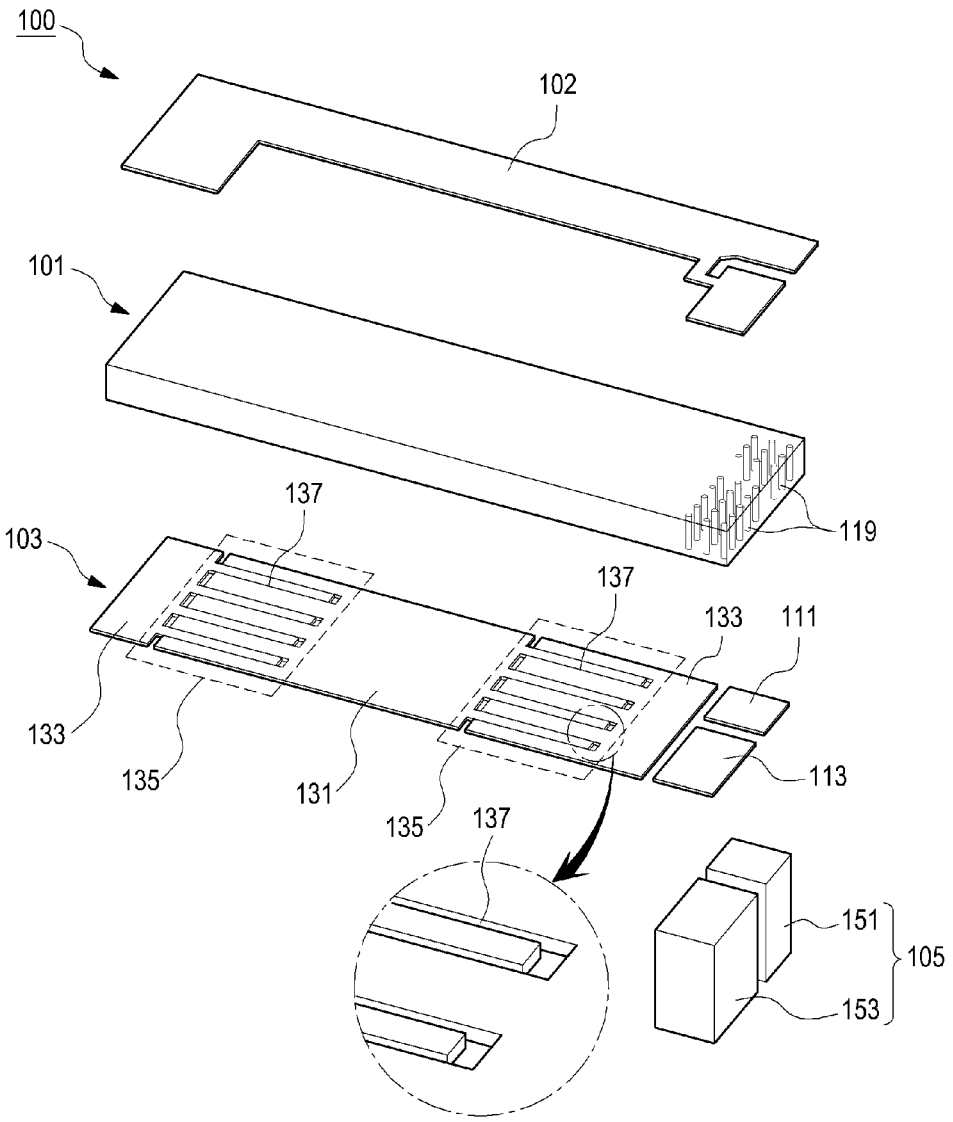
FIG. 3 is an exploded perspective view illustrating an antenna device according to an embodiment of the present disclosure.

FIG. 3 is an exploded perspective view illustrating an antenna device according to an embodiment of the present disclosure.

Referring to FIG. 3, the dielectric substrate 101 may have at least one via hole 119 connecting the conductive radiator pattern 102 to the feeding circuit or the grounding unit G. The via holes 119 may be formed to extend from one surface of the dielectric substrate 101 to the other surface thereof. The conductive radiator pattern 102 may be formed on one surface of the dielectric substrate 101 in various patterns, it may be formed as a printed circuit pattern, or it may be formed by processing a metal thin plate and attaching it to the dielectric substrate 101. In arranging the conductive radiator pattern 102 on one surface of the dielectric substrate 101, at least a part of the conductive radiator pattern 102 may be positioned to correspond to the via holes 119.

The AMC layer 103 may be composed of a metal pattern forming at least one unit cell, and the unit cell may form a resonance circuit composed of parallel inductance and series capacitance. For example, a plurality of conductor unit patterns 131, 133 may be arranged in series, while forming capacitive coupling with each other, and form the unit cell, and thus the AMC layer 103. FIG. 3 illustrates an exemplary configuration where the AMC layer 103 includes second conductor unit patterns 133 formed adjacent to both ends of a first conductor unit pattern 131, respectively. The second conductor unit patterns 133 capacitively couple with the first conductor unit pattern 131, respectively, and an interdigital structure 135, e.g. meander line gaps 137, between the first and second conductor unit patterns 131, 133 to obtain a high capacitive component. Between the gaps 137, the first or second conductor unit patterns 131, 133 may provide a grounding unit and inductive coupling.

An embodiment of the present disclosure illustrates a configuration where the AMC layer 103 has three conductor unit patterns 131, 133 arranged in series adjacent to one another through the interdigital structure 135. However, the number of conductor unit patterns 131, 133 may be varied depending on specifications required by the antenna device 100. For example, a plurality of first conductor unit patterns 131 and a plurality of second conductor unit patterns 133 may alternately arranged in series so that an interdigital structure 135 is provided between adjacent conductor unit patterns 131, 133. In addition, a specific embodiment of the present disclosure illustrates a configuration where the interdigital structure 135 constitutes a meander line gap, but the shape of the interdigital structure may be changed variously.

The shorting pin 105 may include a signal pin 151 for providing a signal and a grounding pin 155 for providing a connection to ground. In an embodiment, the antenna device 100 may have a feeding pad 111 and a grounding pad 113, respectively, so that the shorting pin 105 is stably connected to the dielectric substrate 101. The feeding pad 111 and the grounding pad 113 may be arranged on the other surface of the dielectric substrate 101 and positioned to correspond to parts of the via holes 119, respectively. The feeding pad 111 and the grounding pad 113 may establish electric coupling with the conductive radiator pattern 102 through the via holes 119. In addition, the AMC layer 103 may be shorted to the main circuit substrate 109 through the shorting pin 105. For example, the AMC layer 103 may be connected to the grounding unit G or feeding circuit of the main circuit substrate 109 through the shorting pin 105.

The shorting pin 105, e.g. at least one of the signal pin 151 and the grounding pin 153, may be connected to one of the first and second conductor unit patterns 131, 133 at one end of the unit cell, i.e. at one end of the first and second conductor unit patterns 131, 133. As used herein, the expression "the shorting pin 105 is connected to one of the first and second conductor unit patterns 131, 133" includes not only a configuration of direct connection through wires or printed circuit patterns, but also a configuration of positioning a part of the shorting pin 105 to be adjacent to the first and second conductor unit patterns 131, 133 and establishing electric coupling. The shorting pin 105 shorts one of the first and second conductor unit patterns 131, 133 to the main circuit substrate 109, thereby compensating for the inductance component of the antenna device 100 that is compact while having an AMC structure.

Figure 4:
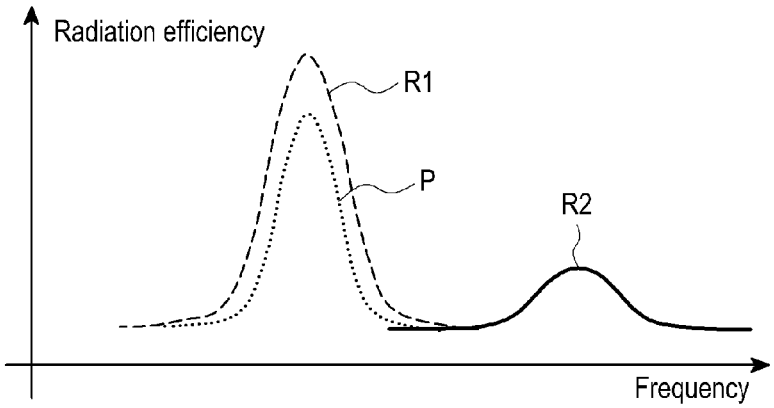
FIG. 4 illustrates operating characteristics of an antenna device according to an embodiment of the present disclosure.
Figure 5:
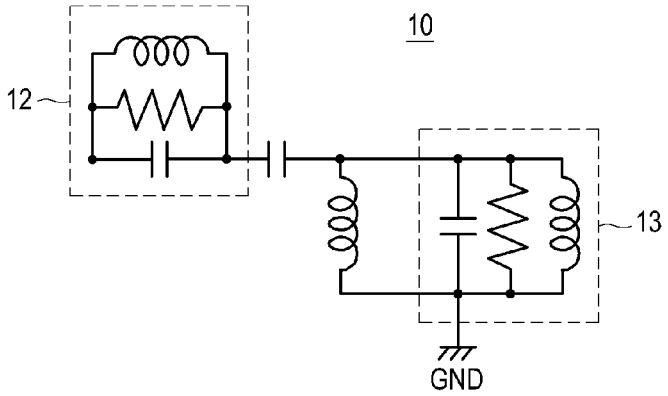
FIG. 5 is a circuit diagram illustrating a configuration of an antenna device according to the related art.
Figure 6:
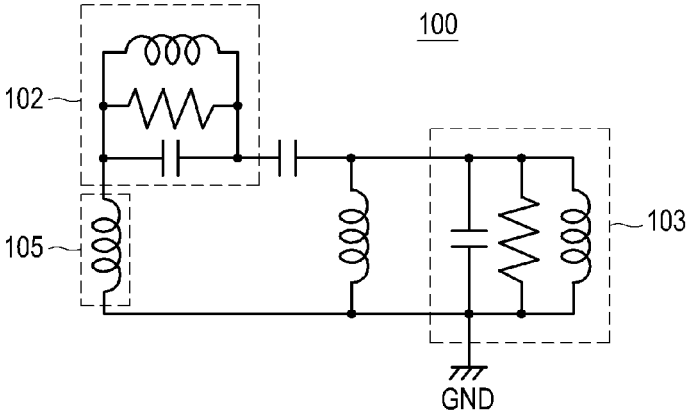
FIG. 6 is a circuit diagram illustrating a configuration of an antenna device according to an embodiment of the present disclosure.

FIG. 4 illustrates operating characteristics of an antenna device according to an embodiment of the present disclosure. FIG. 5 is a circuit diagram illustrating a configuration of an antenna device according to the related art. FIG. 6 is a circuit diagram illustrating a configuration of an antenna device according to an embodiment of the present disclosure.

Referring to FIG. 4, operating characteristics of antenna device 10 of the related art and antenna device 100 according to an embodiment of the present disclosure, measured in an ideal operating environment, are illustrated. That is, neither device is affected by metallic cases or human bodies, for example.

Referring to FIG. 5, reference numeral 12 refers to a circuit configuration of a conductive radiator pattern of an antenna device 10 of the related art, and reference numeral 13 refers to a circuit configuration of an AMC according to various embodiments of the present disclosure.

Referring to FIG. 5 and FIG. 6, the antenna device 100 according to various embodiments of the present disclosure is different from the structure of the antenna device 10 of the related art in that a shorting pin 105 is used to compensate for the inductance component. Such a difference enables the antenna device 100 according to various embodiments of the present disclosure to exhibit improved radiation performance while being smaller than the antenna device 10 of the related art.

An antenna device 10 that employs an AMC structure of the related art, e.g. an AMC composed of a unit cell combination with a 7×7 arrangement or a unit cell combination with a 9×5 arrangement, has a horizontal×vertical size of 66 mm×66 mm or 60 mm×40 mm. The antenna device according to various embodiments of the present disclosure has a size of 18 mm×6 mm×1 mm (horizontal×vertical×thickness), meaning that it can be compactly configured. As used herein, the thickness of the antenna device refers to the thickness of the dielectric substrate.

In FIG. 4, "R1" refers to radiation efficiency of an antenna device 10 realized based on the structure illustrated in FIG. 5 while having a size according to the related art, and "P" refers to radiation efficiency of an antenna device 100 according to various embodiments of the present disclosure. In addition, in FIG. 4, "R2" refers to radiation efficiency of an antenna device which has the structure illustrated in FIG. 5, but the size of which has been simply reduced.

It is clear from comparison of R1 and R2 in FIG. 4 that an antenna device 10 employing an AMC structure of the related art requires a predetermined size, e.g. 66 mm×66 mm (horizontal×vertical), in order to obtain sufficient radiation efficiency in a desired frequency band. The size of such an antenna device 10 may be simply reduced, but such size reduction substantially distorts the resonance frequency and critically degrades the radiation efficiency. Therefore, it is inappropriate to install an antenna device 10 with a structure of the related art in an electronic apparatus that needs to be compact and light, such as a mobile communication terminal or a medical electronic apparatus that is supposed to be attached to a human body (e.g. an electrocardiography (ECG) sensor).

It has been described above that the antenna device 100 according to various embodiments of the present disclosure can be made smaller than the antenna device 10 of the related art. For example, the antenna device according to various embodiments of the present disclosure can be manufactured to have a size of 18 mm×6 mm×1 mm (horizontal×vertical×thickness).

It is clear from a comparison of R1 and P in FIG. 4 that the antenna device 100 has secured stable operating characteristics in the operating frequency band of the antenna device 10 of the related art, although the radiation efficiency is degraded to some extent. As illustrated in FIG. 4, the radiation efficiency of the antenna device 100 according to various embodiments of the present disclosure is degraded to some extent in an ideal operating environment, but it is possible to secure radiation efficiency better than the antenna device 10 of the related art in an actual operating environment, e.g. when attached to a human body or when installed inside a metallic case. This will be described in more detail with reference to FIG. 7 to FIG. 10.

Figure 7:
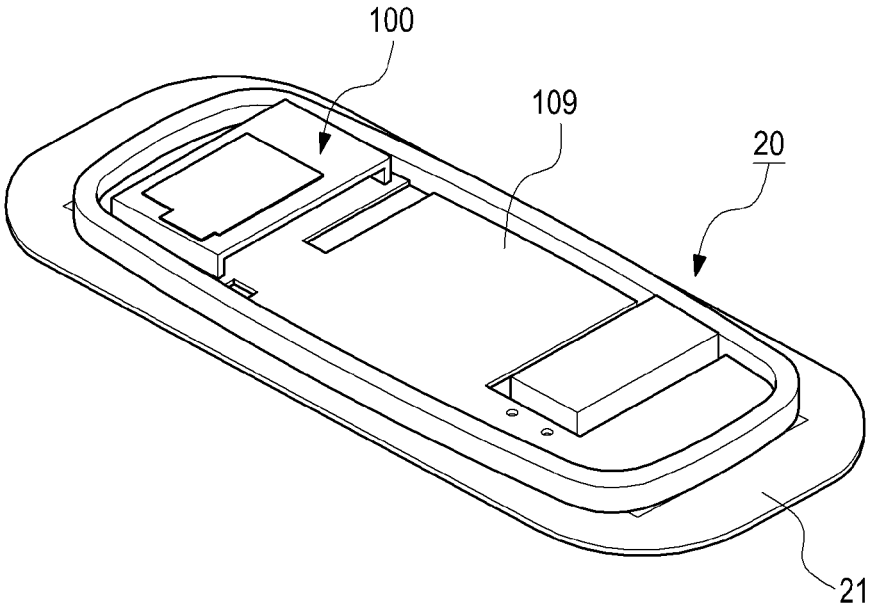
FIG. 7 is a perspective view illustrating a medical electronic apparatus equipped with an antenna device according to an embodiment of the present disclosure.
Figure 8:
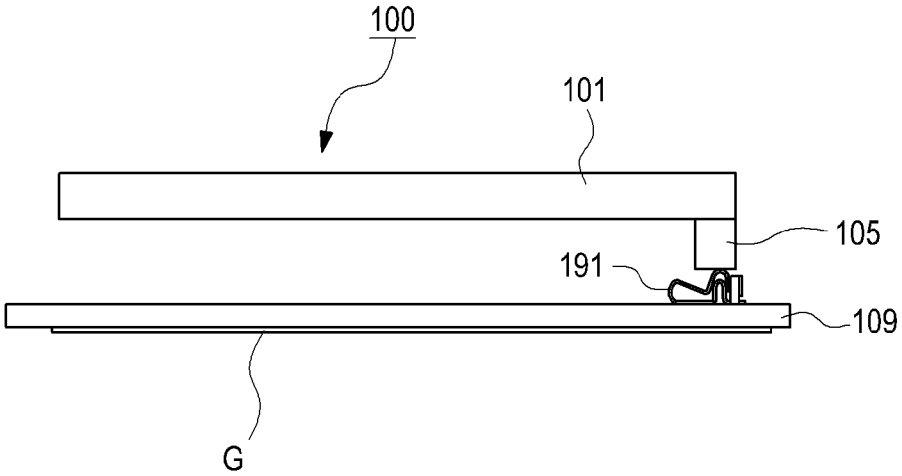
FIG. 8 is a side view of the antenna device illustrated in FIG. 7 according to an embodiment of the present disclosure.

FIG. 7 is a perspective view illustrating a medical electronic apparatus equipped with an antenna device according to an embodiment of the present disclosure. FIG. 8 is a side view of the antenna device illustrated in FIG. 7.

Referring to FIGS. 7 and 8, an ECG sensor 20 is illustrated as an example of the medical electronic apparatus. The ECG sensor 20 is configured by arranging a main circuit substrate 109 and the antenna device 100 on an inner surface of a cover member 21, and the shorting pin 105 can short the AMC layer 103 to the main circuit substrate 109 through a C-clip 191 installed on the main circuit substrate 109. When the antenna device 100 is mounted on the ECG sensor 20 as described above, the distance between the dielectric substrate 101 and the main circuit substrate 109 is approximately 3 mm, and the thickness of the dielectric substrate 101 is approximately 1 mm, meaning that the antenna device 100 can have a height of approximately 4 mm from one surface of the main circuit substrate 109.

Radiation efficiency measured when an ECG sensor 20, which is equipped with an antenna device 100 according to various embodiments of the present disclosure based on the above-mentioned structure, is attached to a human body is compared with radiation efficiency measured when an ECG sensor, which is equipped with an antenna device 10 of the related art, is attached to a human body, as given in Table 1 below.

TABLE 1

| ECG sensor | Antenna device of the related art | Antenna device according to present disclosure |
|---|---|---|
| Resonance frequency | 2.4 GHz | 2.4 GHz |
| Radiation efficiency | 5% | 38% |
| Total height | 4 mm | 4 mm |

It is clear from Table 1 that the radiation efficiency of the antenna device of the related art, which is mounted on an ECG sensor, drops to 5% when it operates while being attached to a human body. In contrast, the antenna device 100 according to various embodiments of the present disclosure maintains radiation efficiency of about 38% even when the ECG sensor 20 is attached to a human body, meaning that the antenna device 100 according to various embodiments of the present disclosure can exhibit stable operating characteristics in actual use environments.

Figure 9:
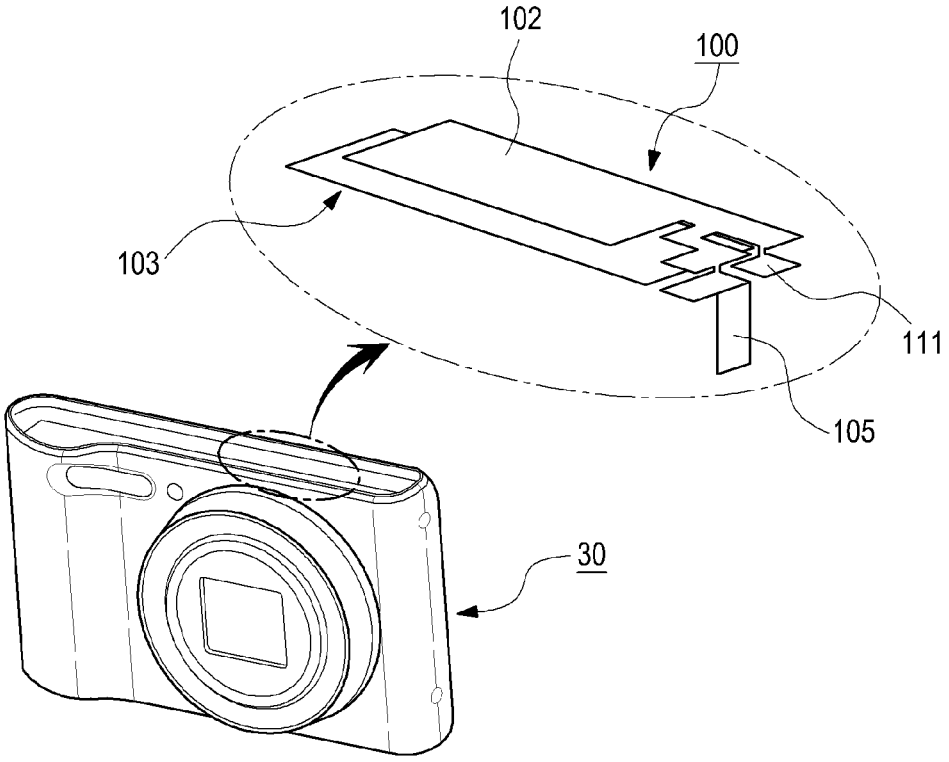
FIG. 9 is a perspective view illustrating an electronic apparatus equipped with an antenna device according to an embodiment of the present disclosure.
Figure 10:
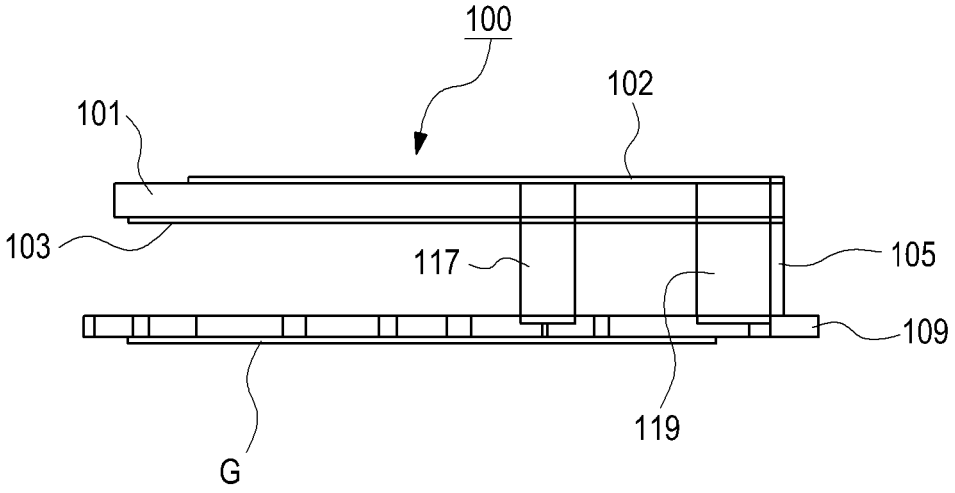
FIG. 10 is a side view of the antenna device illustrated in FIG. 9 according to an embodiment of the present disclosure.

FIG. 9 is a perspective view illustrating an electronic apparatus equipped with an antenna device according to an embodiment of the present disclosure. FIG. 10 is a side view of the antenna device illustrated in FIG. 9 according to an embodiment of the present disclosure.

Referring to FIGS. 9 and 10, a digital camera 30 is illustrated as an example of the electronic apparatus, and the external case of the digital camera 30 may be made of a metallic material, such as magnesium, aluminum, or an alloy equivalent thereto. It is to be noted that the top of the digital camera 30 is cut away in FIG. 9, and the dielectric substrate of the antenna device 100 is not illustrated, but only a conductive radiator pattern 102 and an AMC layer 103, which are arranged on one surface and the other surface of the dielectric substrate, respectively, are illustrated. In addition, the antenna device 100 may include a feeding pad 111 arranged on the same surface as the AMC layer 103, and a shorting pin 105 may be connected to the AMC layer 103 on the other surface of the dielectric substrate to short the AMC layer 103 to the main circuit substrate 109. Meanwhile, as illustrated in FIG. 10, the conductive radiator pattern 102 may be connected to a feeding circuit and a grounding unit G of the main circuit substrate 19 through a separate feeding line 117 and a grounding line 119, respectively. The feeding line 117 and the grounding line 119 may be made of flexible printed circuit boards, respectively. In an embodiment, if the conductive radiator pattern 102 is made of a metal thin plate, the feeding line 117 and the grounding line 119 may extend from the conductive radiator pattern 102 as parts of the metal thin plate, respectively.

A more detailed configuration of the antenna device 100, which is mounted on the digital camera, may be implemented in a more diversified manner through configurations of the above-mentioned various embodiments.

In connection with installing the antenna device 100 on an electronic apparatus as described above, e.g. a digital camera 30 including a case made of a metallic material, the distance between the dielectric substrate 101 and the main circuit substrate 109 is approximately 3 mm, and the thickness of the dielectric substrate 101 is approximately 1 mm, meaning that the antenna device 100 can have a height of approximately 4 mm from one surface of the main circuit substrate 109.

Radiation efficiency measured when an antenna device 100 according to various embodiments of the present disclosure is mounted on the digital camera 30 according to the above-mentioned structure is compared with radiation efficiency measured when an antenna device 10 of the related art is mounted on the same digital camera, as given in Table 2 below.

TABLE 2

| Electronic apparatus (digital camera) | Antenna device of the related art | Antenna device according to present disclosure |
|---|---|---|
| Resonance frequency | 2.4 GHz | 2.4 GHz |
| Radiation efficiency | 15-18% | 28-35% |
| Total height | 4 mm | 4 mm |

It is clear from Table 2 that the radiation efficiency drops to 15-18% when the antenna device 10 of the related art, which is mounted on an electronic apparatus including a metallic case, operates. In contrast, the antenna device 100 according to various embodiments of the present disclosure maintains radiation efficiency of about 28-35% even when mounted on an electronic apparatus including a metallic case, meaning that it can exhibit stable operating characteristics.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An antenna device comprising:
- a dielectric substrate;
- a conductive radiator pattern formed on a first surface of the dielectric substrate;
- an artificial magnetic conductor layer, comprising at least one unit cell including a plurality of conductor unit patterns arranged in series adjacent to one another through an interdigital structure, formed on a second surface of the dielectric substrate, the second surface being opposite to the first surface;
- a feeding pad formed on the second surface of the dielectric substrate and adjacent to the artificial magnetic conductor layer;
- a ground pad formed on the second surface of the dielectric substrate and adjacent to the artificial magnetic conductor layer; and
- a shorting pin connected to the unit cell and configured to compensate for an inductance component of the artificial magnetic conductor layer,
- wherein the artificial magnetic conductor layer is configured to form an induction current of the same phase with regard to a signal current flowing through the conductive radiator pattern.

2. The antenna device of claim 1, wherein the unit cell is composed of a metal pattern forming a resonance circuit composed of a parallel inductance and a series capacitance.

3. The antenna device of claim 1, wherein the unit cell comprises:
- a first conductor unit pattern;
- second conductor unit patterns formed adjacent to both ends of the first conductor unit pattern, respectively; and
- gaps formed between the first conductor unit pattern and respective second conductor unit patterns,
- wherein capacitive coupling is formed between the first and the second conductor unit patterns through the gaps.

4. The antenna device of claim 3, wherein a plurality of the first and the second conductor unit patterns are arranged alternately to form capacitive coupling.

5. The antenna device of claim 4, wherein the shorting pin is connected to one of the first and the second conductor unit patterns at one end of the unit cell.

6. The antenna device of claim 5, wherein the shorting pin comprises at least one of a flexible printed circuit board, a metal conductor, and a C-clip.

7. The antenna device of claim 5, wherein the shorting pin comprises at least one of a signal pin and a grounding pin.

8. The antenna device of claim 4, wherein at least one of the first and the second conductor unit patterns provide a grounding unit and inductive coupling between the gap and an adjacent different gap.

9. An electronic apparatus comprising:
- a main circuit substrate; and
- an antenna device arranged on the main circuit substrate,
- wherein the antenna device comprises:
  - a dielectric substrate;
  - a conductive radiator pattern formed on a first surface of the dielectric substrate;
  - an artificial magnetic conductor layer, composed of a metal pattern and including a plurality of conductor unit patterns arranged in series adjacent to one another through an interdigital structure, formed on a second surface of the dielectric substrate, the second surface being opposite to the first surface;

a feeding pad formed on the second surface of the dielectric substrate and adjacent to the artificial magnetic conductor layer;

a ground pad formed on the second surface of the dielectric substrate and adjacent to the artificial magnetic conductor layer; and a shorting pin connected to the artificial magnetic conductor layer and configured to compensate for an inductance component of the artificial magnetic conductor layer, wherein the shorting pin is configured to electrically connect the artificial magnetic conductor layer to the main circuit substrate.

10. The electronic apparatus of claim 9, wherein the second surface of the dielectric substrate faces the main circuit substrate.

11. The electronic apparatus of claim 9, wherein the artificial magnetic conductor layer comprises at least one unit cell composed of a first conductor unit pattern and a pair of second conductor unit patterns, and wherein the first and the second conductor unit patterns form capacitive coupling.

12. The electronic apparatus of claim 11, wherein the shorting pin is configured to short one of the first and the second conductor unit patterns to ground of the main circuit substrate.

13. The electronic apparatus of claim 11, wherein a plurality of the first conductor unit patterns and a plurality of the second conductor unit patterns are alternately arranged in series.

14. The electronic apparatus of claim 13, wherein the shorting pin is configured to short one of the first and the second conductor unit patterns to the ground at one end of the first and the second conductor unit patterns.

15. The electronic apparatus of claim 14, wherein the shorting pin comprises at least one of a flexible printed circuit board, a metal conductor, and a C-clip.

16. The electronic apparatus of claim 14, wherein the shorting pin comprises at least one of a signal pin and a grounding pin.

17. The electronic apparatus of claim 9, wherein the metal pattern is configured to form a resonance circuit composed of a parallel inductance and a series capacitance.

* * * * *